US006089948A

United States Patent [19]

LaBarbara, Jr. et al.

[11] Patent Number: 6,089,948

[45] Date of Patent: Jul. 18, 2000

[54] BANJO-PLAYING TOY

[75] Inventors: A. Franklin LaBarbara, Jr., Rumford; Georgina M. Melone, Barrington; Nash S. Desent, N. Kingstown; Gregory R. Horton, Manville, all of R.I.

[73] Assignee: Hasbro, Inc., Pawtucket, R.I.

[21] Appl. No.: 09/262,736

[22] Filed: Mar. 5, 1999

[51] Int. Cl.[7] ..... A63H 13/04; A63H 3/46; A63H 3/52; G09F 19/08

[52] U.S. Cl. ..... 446/318; 446/384; 446/408; 40/419

[58] Field of Search ..... 446/318, 218, 446/297, 298, 277, 300, 302, 303, 330, 338, 352, 353, 373, 374, 384, 408; 40/417, 418, 419, 455, 456

[56] References Cited

U.S. PATENT DOCUMENTS

| | | | |
|---|---|---|---|
| 1,334,578 | 3/1920 | Wisniefski | 446/318 |
| 1,503,735 | 8/1924 | Williams | 446/318 |
| 1,519,410 | 12/1924 | Marx | 446/318 |
| 1,742,844 | 1/1930 | Berger | 446/318 |
| 2,641,867 | 6/1953 | McEntyre et al. | 446/318 X |
| 3,273,894 | 9/1966 | Clawson . | |
| 3,555,722 | 1/1971 | McLain et al. | 446/268 X |
| 3,698,125 | 10/1972 | Hartling et al. . | |
| 4,545,775 | 10/1985 | Kim . | |
| 4,571,207 | 2/1986 | Henderson et al. | 446/268 X |
| 4,778,432 | 10/1988 | Yeu . | |
| 4,828,530 | 5/1989 | Lee . | |
| 4,911,676 | 3/1990 | Fan | 40/419 X |
| 4,913,676 | 4/1990 | Koguchi et al. . | |
| 5,557,057 | 9/1996 | Starr . | |
| 5,735,726 | 4/1998 | Cohen . | |

FOREIGN PATENT DOCUMENTS 2 063 691 6/1981 United Kingdom .

OTHER PUBLICATIONS

Rock'n'Roll Elmo, http://www.verimall.com/gifts/spree4.htm, p. 2 For sale Christmas 1998.

*Primary Examiner*—D. Neal Muir
*Attorney, Agent, or Firm*—Fish & Richardson PC

[57] ABSTRACT

A toy which simulates playing a toy stringed instrument is provided. The toy stringed instrument is attached to a body of the toy and a disc couples the body to the toy stringed instrument. A hand on the body is secured to the disc which rotates in response to activation of a motor housed in the body. Thus, rotation of the disc causes corresponding rotation of the hand. A controller is configured to produce music and to activate the motor in conjunction with the music.

14 Claims, 8 Drawing Sheets

BANJO-PLAYING TOY

TECHNICAL FIELD

This invention relates to a toy which simulates playing a musical instrument.

BACKGROUND

Toys may have animation mechanisms and may produce sounds. For example, a part of a toy may move or the toy may speak a sentence in response to a child's action.

SUMMARY

A toy doll simulates playing a toy stringed instrument. The toy doll includes a body with a hand, a housing inside the body and containing a motor, and a toy stringed instrument. A disc positioned in the toy stringed instrument and coupled to the motor rotates in response to motor activation. A controller produces music and activates the motor in conjunction with the music. The hand is secured to a surface of the disc such that rotation of the disc causes corresponding rotation of the hand.

Embodiments may include one or more of the following features. For example, the body may include a head which tilts from side to side in conjunction with the music.

The housing may include a gear coupled to the disc and configured to rotate and produce rotation of the disc in response to the activation of the motor. The gear may also be coupled to the head to produce tilting of the head in response to the activation of the motor.

The toy stringed instrument may include a button in the shape of a musical note which, when pressed, causes the controller to produce the music and activate the motor.

Other features and advantages will be apparent from the following description, including the drawings, and from the claims.

DETAILED DESCRIPTION

Figure 1:
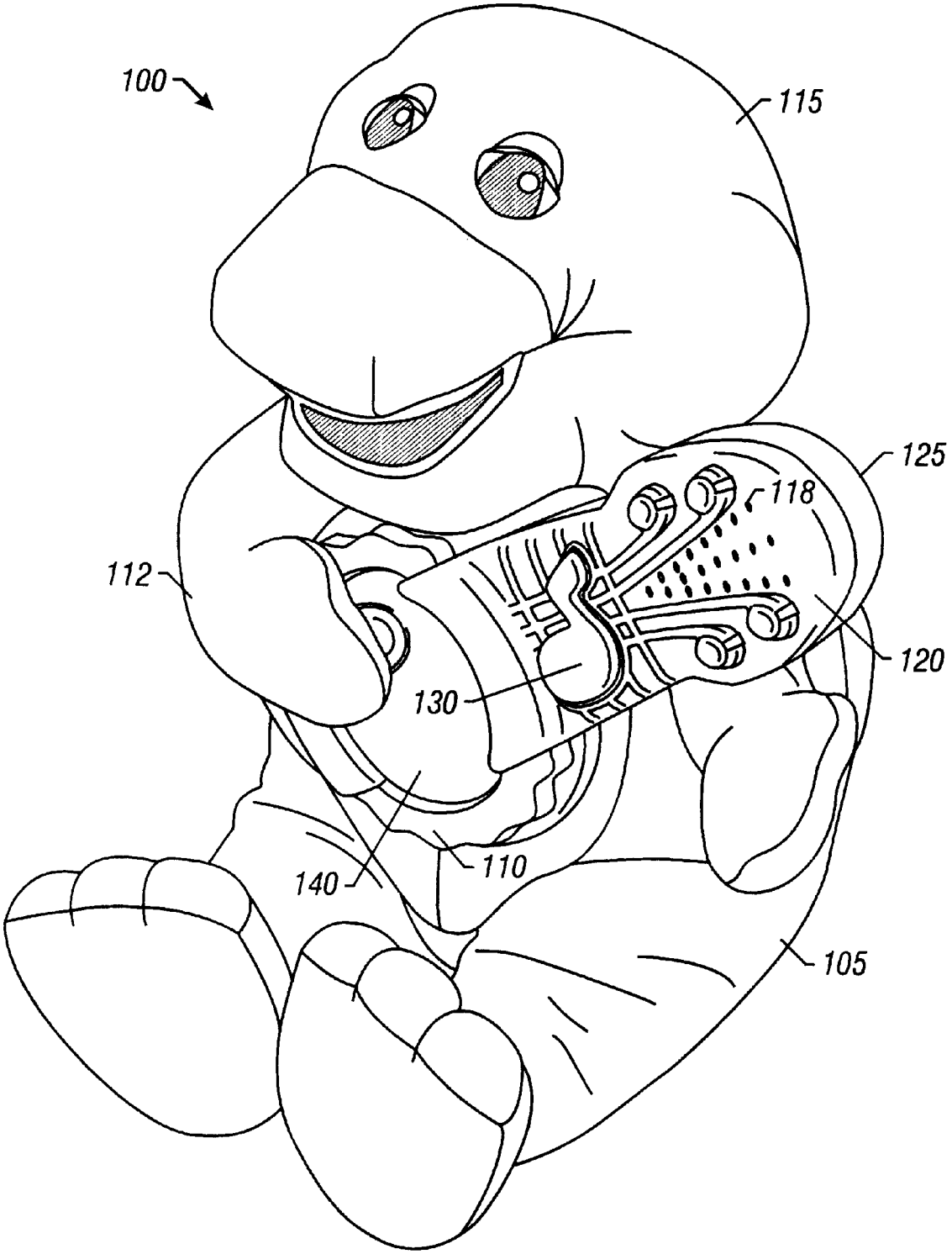
FIG. 1 is a perspective view of a toy having a musical instrument.

Referring to FIG. 1, a toy 100 includes a character doll 105 and a toy stringed instrument 110. As shown in FIG. 1, the doll 105 is implemented as a purple Barney™ the dinosaur. When turned on, a controller inside the instrument 110 causes a hand 112 of the doll 105 to strum the instrument 110, causes a head 115 on the doll 105 to tilt from side to side, and reproduces sounds using a speaker positioned beneath sound holes 118. The toy stringed instrument 110 resembles a banjo in visual appearance and produces sounds comparable to those produced by a banjo. Thus, the sounds may include songs that capture the unique qualities of banjo music. An internal housing in the doll 105 provides both electrical power for the sound reproduction and mechanical power for the strumming and tilting action.

The toy stringed instrument 110 includes a front piece 120 and a back piece 125. Ridges and holes are formed on both pieces for alignment and fastening. An ON button 130, in the shape of a musical note, activates a switch that is sandwiched between the front piece 120 and the back piece 125. The array of sound holes 118 are formed in the front piece 120.

A disc 140 links the internal housing to the toy stringed instrument 110 and further joins the hand 112 of the FIG. 105 to the toy stringed instrument 110. The disc 140 is held in position by the toy stringed instrument 110. Rotation of the disc 140 moves the hand 112 to simulate a strumming action.

Figure 2:
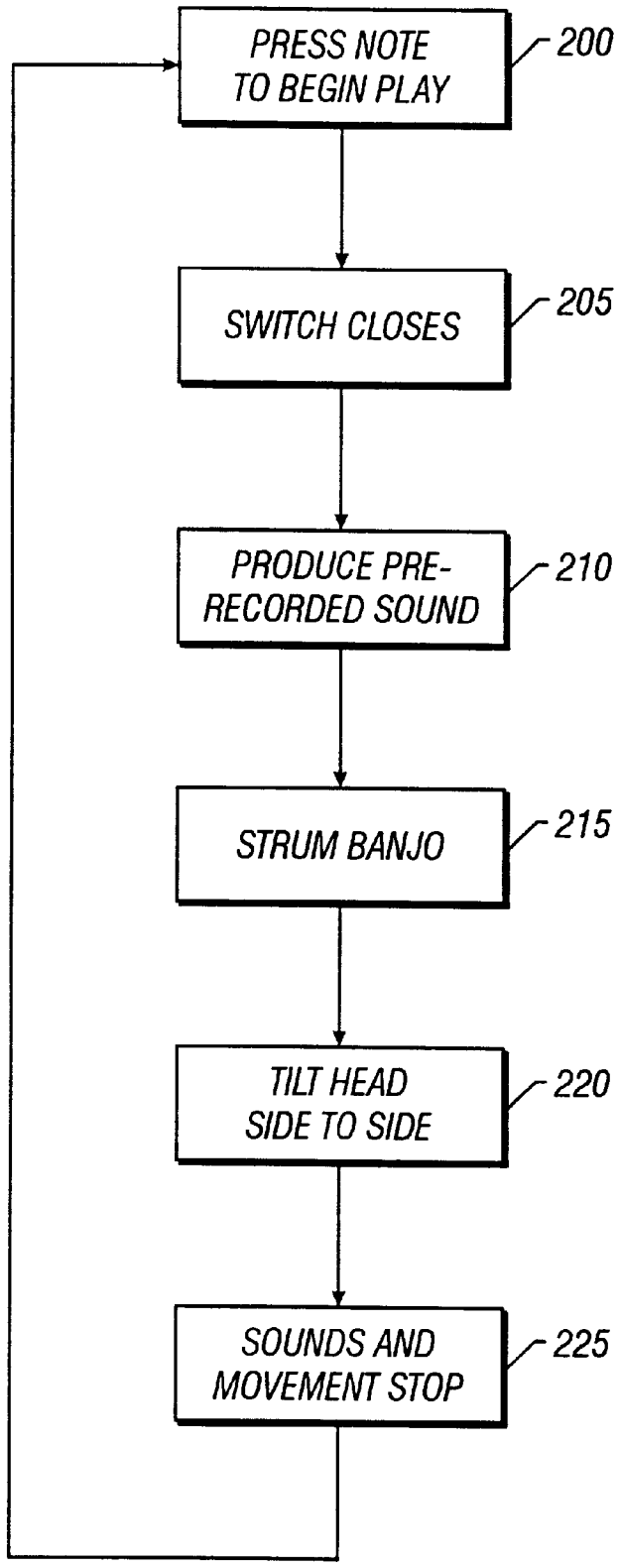
FIG. 2 is a flow chart of a procedure performed by the toy of FIG. 1.

Referring also to FIG. 2, when the ON button 130 is pressed (step 200), a switch closes and activates the toy (step 205). The controller responds to closing of the switch by causing three actions to occur simultaneously. First, the controller produces sounds through a speaker inside the toy stringed instrument 110 (step 210). Second, the controller activates the motor, which rotates the disc 140 and causes the FIG. 105 to produce the strumming action (step 215). Activation of the motor also causes the head of the figure to tilt from side to side (step 220). After the song ends, or the switch is opened manually, sounds and movement of the toy stop (step 225) until the ON switch is pressed again (step 200).

Figure 3:
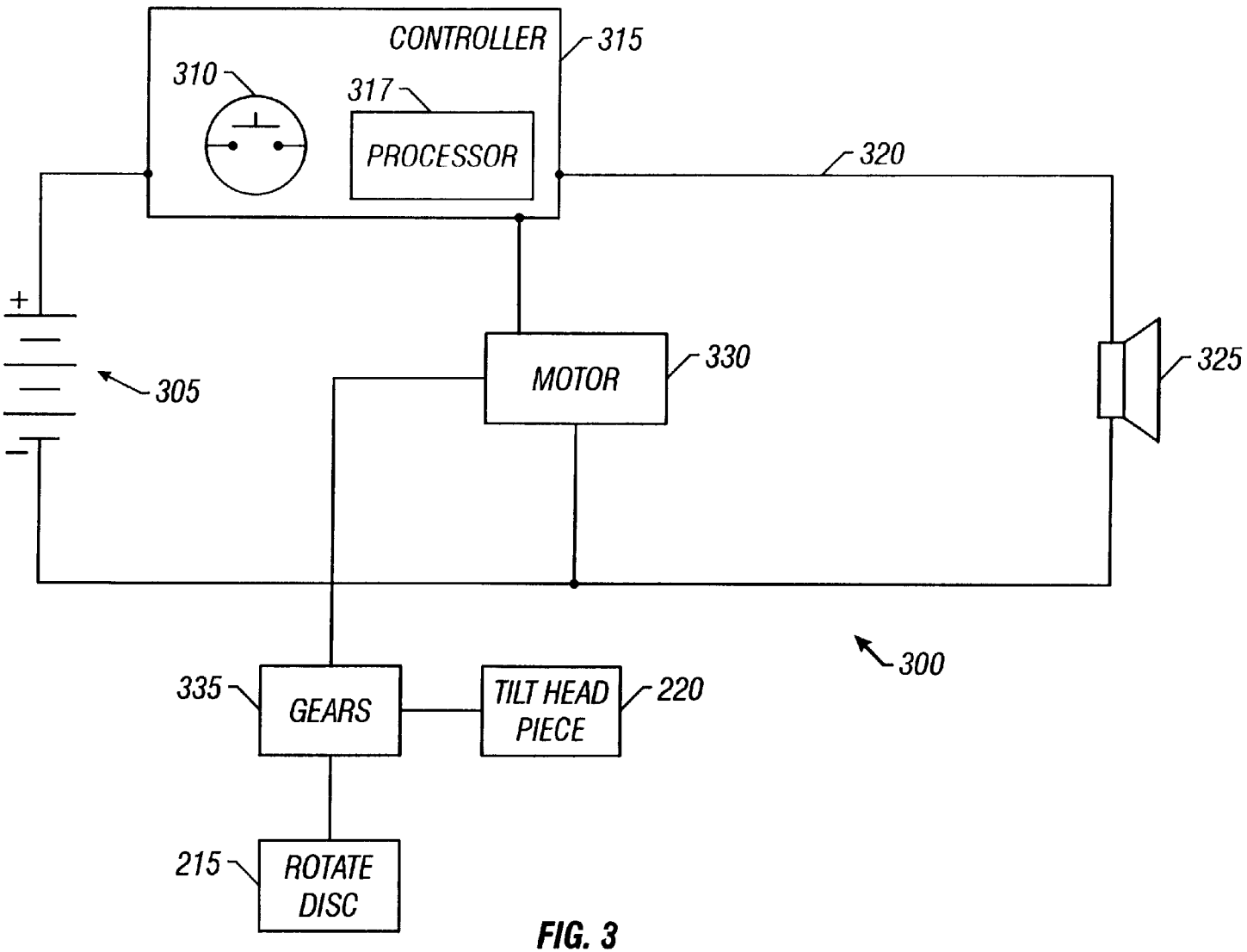
FIG. 3 is an electro-mechanical diagram of operating components of the toy of FIG. 1.

Referring to FIG. 3, the toy is operated by circuitry 300. Electrical power to the toy 100 is provided by three 1.5 V batteries 305. When the ON button 130 is pressed, the switch 310 closes to activate the controller 315. A processor 317 of the controller 315 responds by sending electrical signals to the speaker 325 and to a motor 330. The speaker 325 reproduces the sounds. The motor 330 provides mechanical power through rotational motion of a set of gears 335. The gears 335 serve a dual purpose of tilting the head 115 of the FIG. 105 (step 220) and rotating the disc 140 to produce the strumming action (step 215).

Figure 4:
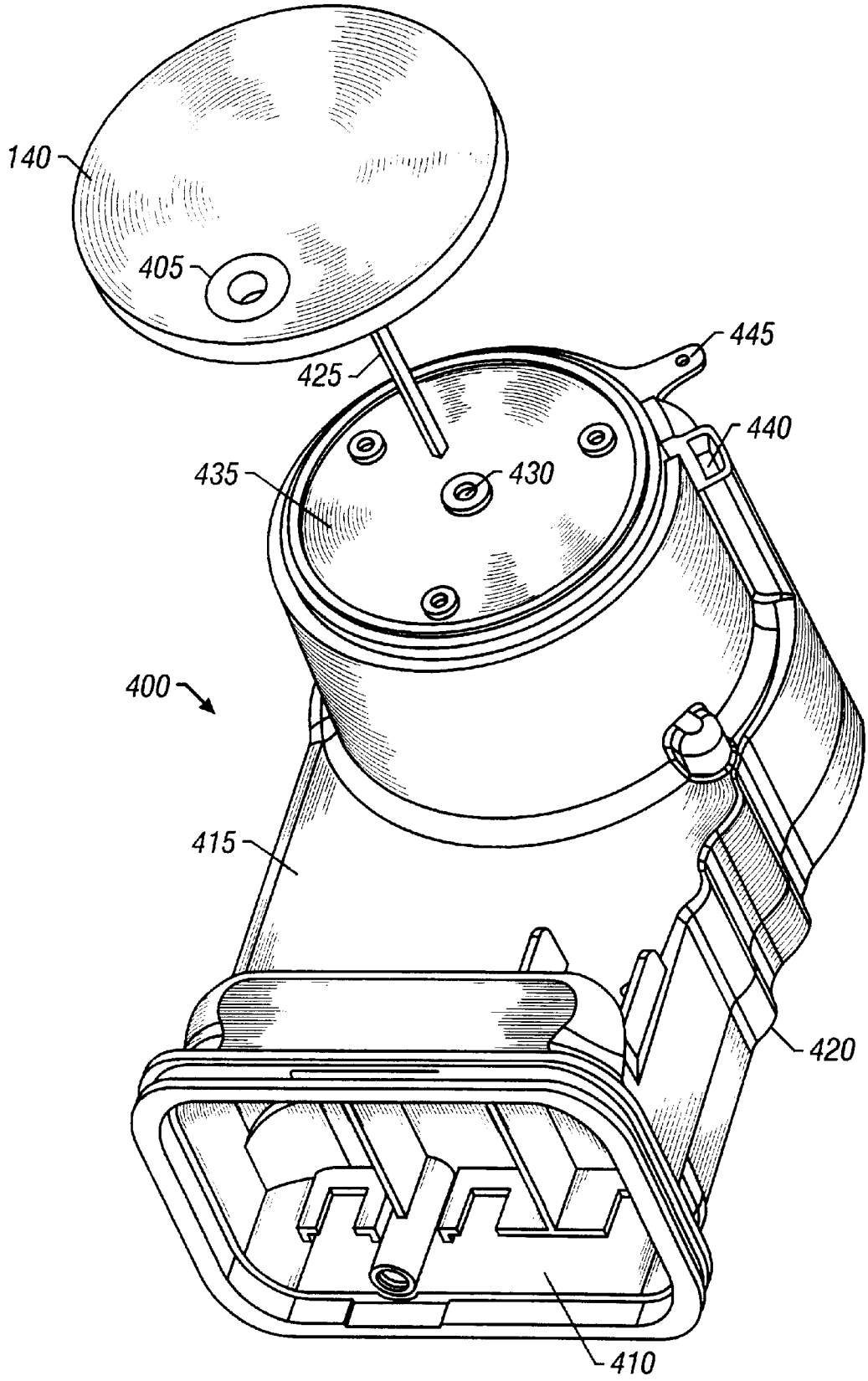
FIG. 4 is a perspective of an internal housing and a disc which links gears in the housing to the exterior of the toy of FIG. 1.

FIG. 4 shows a perspective view of the internal housing 400 and the disc 140 coupling the housing 400 to the toy instrument 110. Not shown in this figure is a head piece 505 (in FIGS. 5 and 6) that extends from a top of the housing 400 to provide support and tilting movement for the head 115 of the doll 105. A hole 405 in the disc 140 receives a knob attached to the hand 112 of the FIG. 105. Thus, when the disc 140 rotates, the hand 112 moves around and the action resembles a strumming motion.

The internal housing 400 includes a power receptacle 410 which holds the batteries 305. The motor 330 is kept inside a main body 415 to provide mechanical power to various gears 335 which are also positioned in the main body 415. The inside of the main body 415 may be exposed by removing a back fitting 420.

A coupling gear 625 (shown in FIG. 6), which performs the double operation of tilting the head piece and rotating the disc 140, is held inside the main body 415. The coupling gear 625 mates with a stem 425 of the disc through the coupling hole 430. A polygonal cross section of the stem 425 matches a polygonal cross section of a female receptacle formed at the center of the coupling gear, so that the disc 140 is rotated by rotation of the gear. The installed disc 140 rests on a circular surface 435 of the internal housing 400. Electrical wires from the motor 330 and the power supply travel out of the housing 400 and into the instrument 110 through a port 440. The instrument 110 is mounted on the housing 400 through a mounting hole 445 which aligns with a second mounting hole on the back piece 125 of the toy instrument 110.

Figure 5:
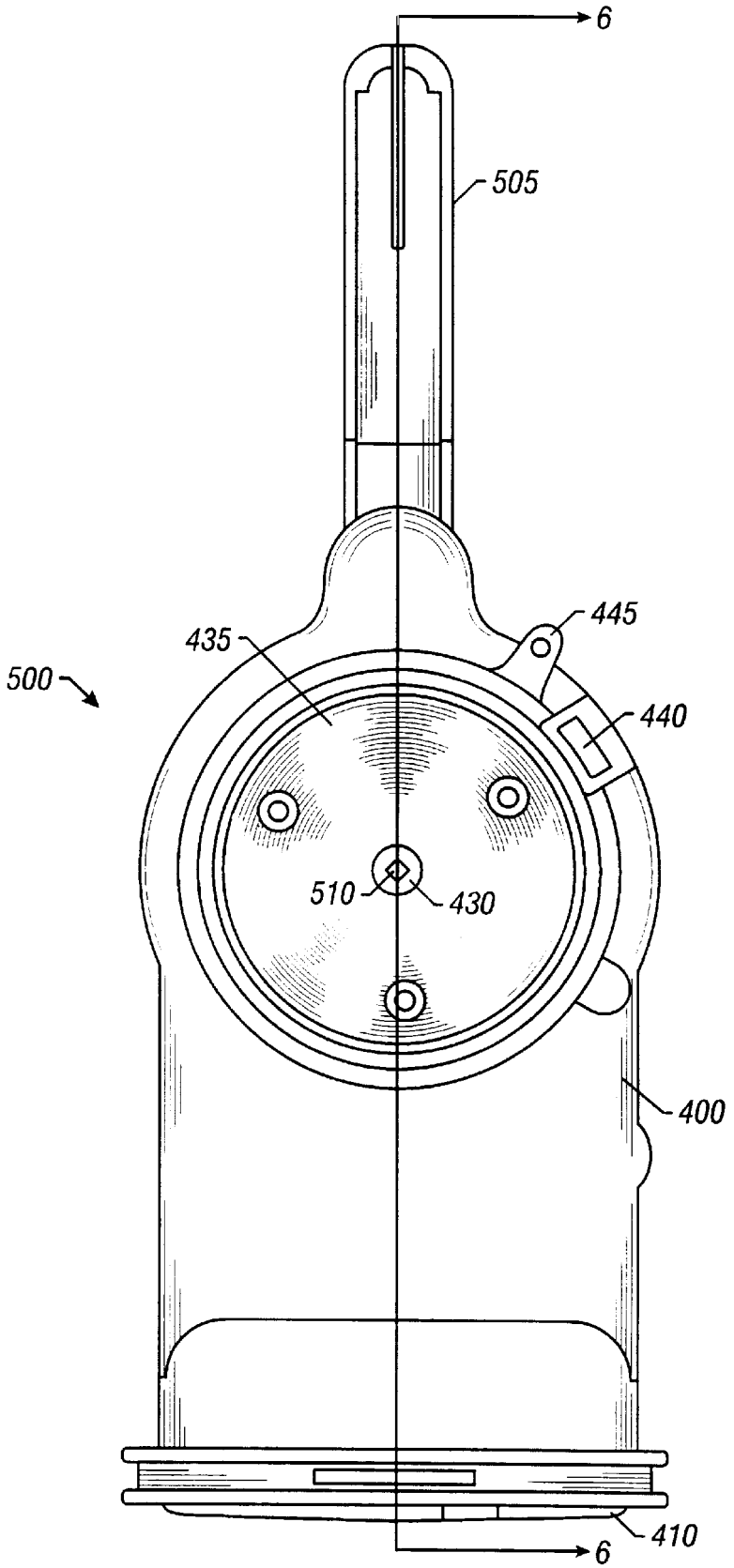
FIG. 5 is a front view of the internal housing of FIG. 4 with a head piece attached.

FIG. 5 is a front view 500 of the internal housing 400 of FIG. 4. Shown in FIG. 5 is the head piece 505 that protrudes from the housing 400 into the head 115 of the doll 105. Tilting action of the head piece 505 results from a rotation of the coupling gear 625. Also visible in FIG. 5 is the female receptacle 510 at the center of the coupling gear, which joins with the stem 425 of the disc 140.

Figure 6:
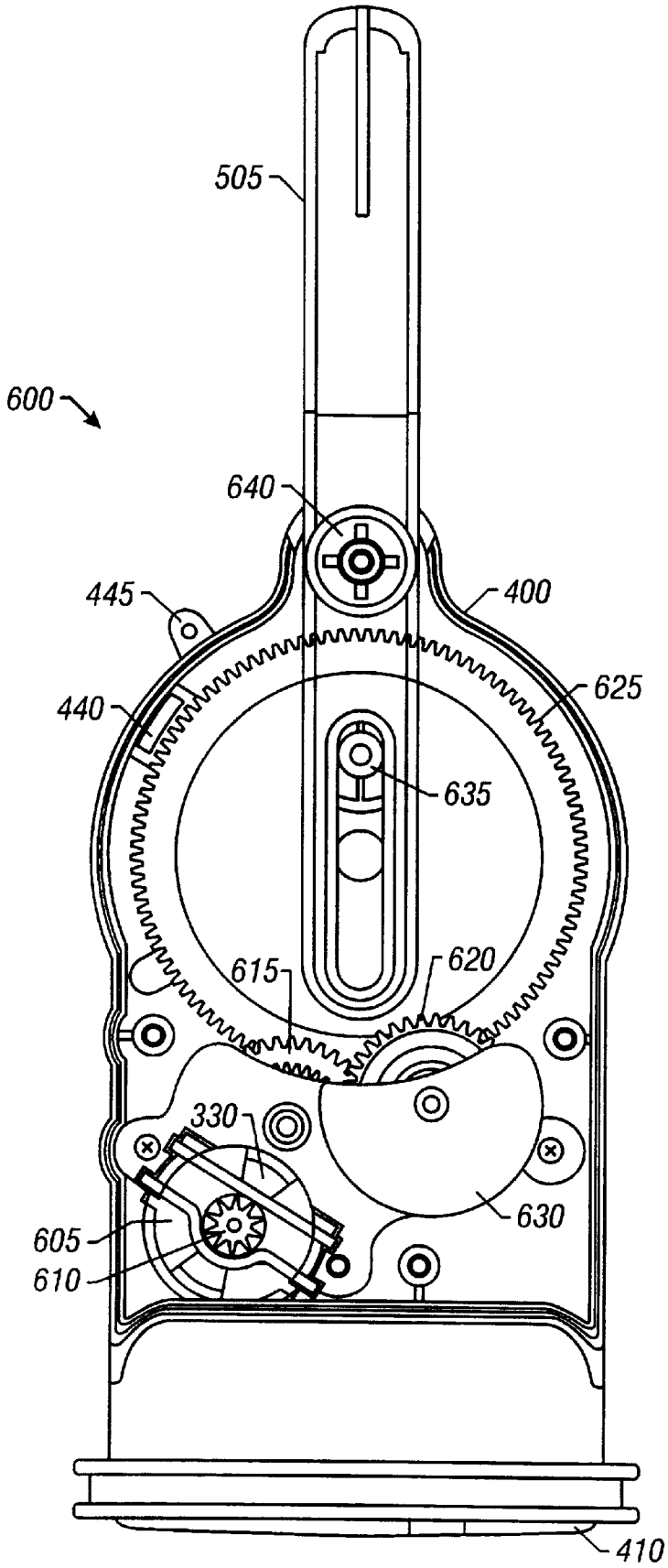
FIG. 6 is a sectional rear view of the internal housing of FIG. 5.

FIG. 6 is a back view 600 of the internal housing 400 with the back fitting 420 removed. Various gears move in response to the motor 330. The motor 330 is covered by plastic insulators 605 and may contain a pinion 610 to provide mechanical linkage. The motor 330 is coupled to a spur gear 615 via a rubber belt (not visible). The spur gear 615 links with a clutch gear assembly 620 which then links with the coupling gear 625. To prevent slippage, the clutch gear assembly 620 is covered by a gear cover 630. The headpiece 505 is connected to a joint 635 on a radius of the coupling gear 625 and to a joint 640 on the top of the internal housing. Thus, when the gear 625 rotates, the joint 635 rotates and causes the headpiece 505 to tilt from side to side.

Figure 7:
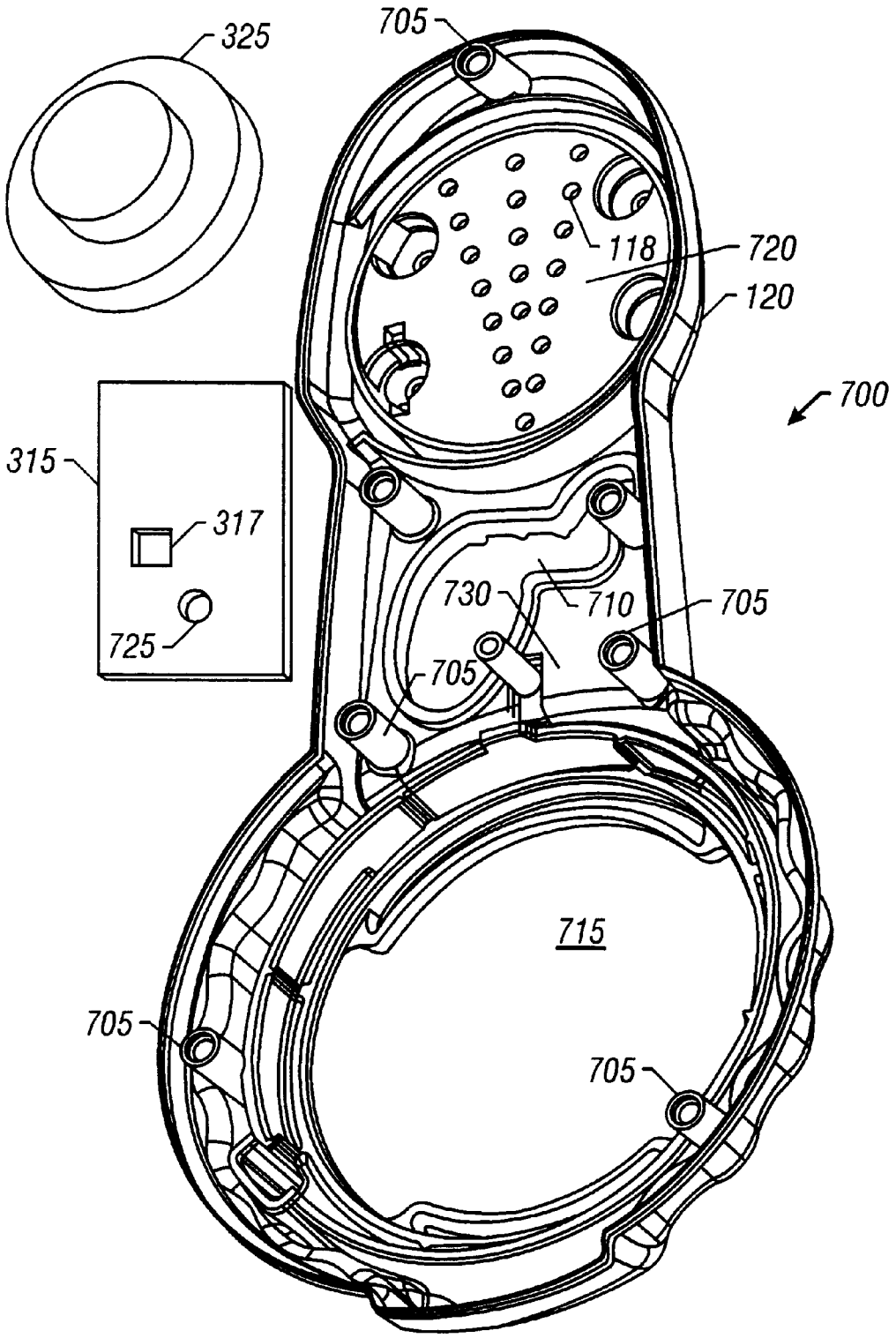
FIG. 7 is an inside perspective view of a front piece of a toy stringed instrument of the toy of FIG. 1.

FIG. 7 is an inside perspective view 700 of the front piece 120 of the toy stringed instrument 110. Secured to the front piece 120 are the speaker 325 and the controller 315.

Various holes 705 are formed around the edge of the piece 120 for alignment with the back piece 125. A hole 710 is formed in the shape of a musical note and has a slightly smaller cross section than the ON button 130. This hole 710 holds the ON button in place when the toy instrument 110 is assembled. Another hole 715 is formed in the shape of a circle and has a slightly smaller cross section than the disc 140. This hole 715 holds the disc 140 in place when the toy instrument 110 is secured to the internal housing 400.

The speaker 325 is secured to an arm section 720 of the front piece 120. Speaker sound emanates through small sound holes 118 on an arm 720 of the front piece 120. The sound holes 118 may be arranged in the shape of the strings of a stringed instrument to make the toy instrument 110 more realistic. The electronics unit 315 is positioned against the ON button hole 710 using a hole 725 which aligns with a sleeve 730 on the front piece 120.

Figure 8:
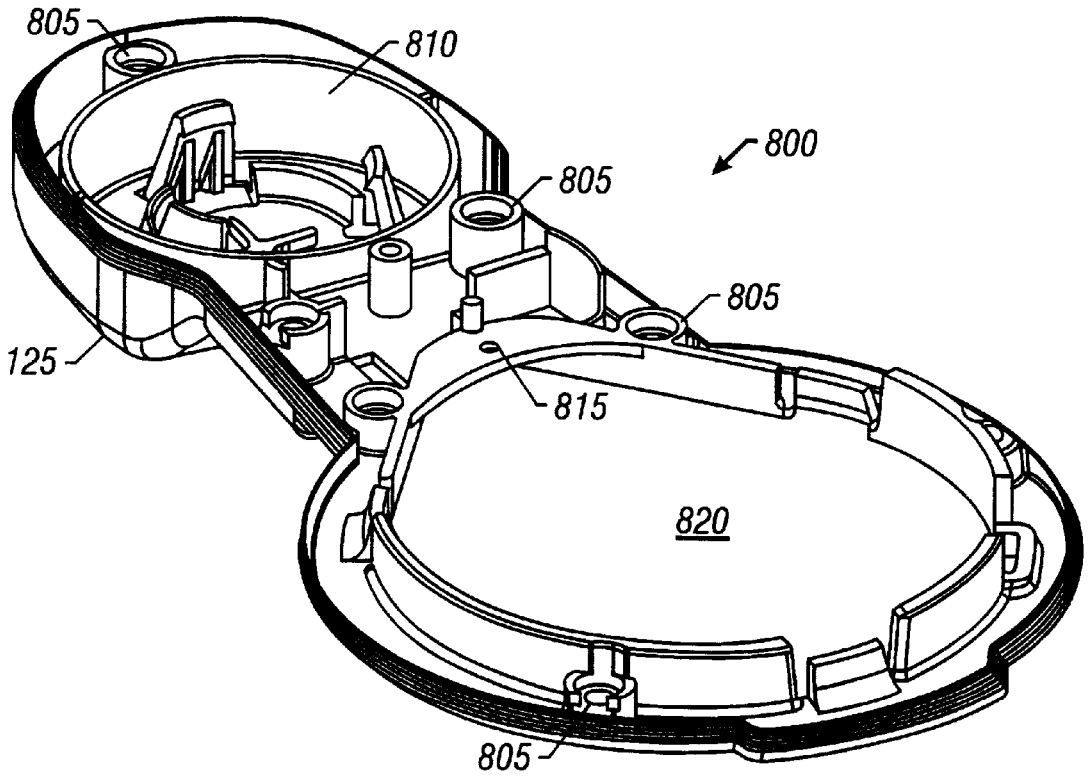
FIG. 8 is an inside perspective view of a back piece of the toy stringed instrument of the toy of FIG. 1.

FIG. 8 is an inside perspective view 800 of the back piece 125 of the toy instrument 110. Various holes 805 are formed along the edge of the piece 125 which align with the holes 705 of the front piece 120. A back end of the speaker 325 fits into an arm section 810 of the back piece 125. When the toy instrument 110 is assembled, it is mounted onto the housing 400 using the second mounting hole 815 which aligns with the mounting hole 445 on the housing 400. A circular hole 820 is formed on the back piece 125 to permit exposure of the disc 140.

Other embodiments are within the scope of the following claims.

What is claimed is:

1. An apparatus comprising:

a body including a hand;

a housing inside the body and containing a motor;

a toy simulated stringed instrument attached to the body;

a disc coupled to the motor, positioned in the toy stringed instrument, and operable to rotate in response to activation of the motor; and a controller configured to produce music and to activate the motor in conjunction with the music, wherein the hand is secured to a surface of the disc such that rotation of the disc causes corresponding rotation of the hand.

2. The apparatus of claim 1, wherein the body includes a head.

3. The apparatus of claim 2, wherein the head is coupled to the motor and configured to tilt from side to side in response to activation of the motor.

4. The apparatus of claim 1, wherein the housing comprises a gear configured to rotate in response to the activation of the motor.

5. The apparatus of claim 4, wherein the gear is coupled to the disc and produces rotation of the disc when the motor is activated.

6. The apparatus of claim 4, wherein the body includes a head and the gear is coupled to the head and produces a tilting of the head when the motor is activated.

7. The apparatus of claim 1, wherein the controller is contained in the toy stringed instrument.

8. The apparatus of claim 7, wherein the toy stringed instrument includes a button in the shape of a musical note which, when pressed, activates the controller.

9. A method of simulating play of a toy simulated stringed instrument, the method comprising:

coupling a body including a hand to the toy stringed instrument;

producing music;

activating a motor in the body in conjunction with the music;

rotating a disc attached to the toy stringed instrument in response to the motor activation;

securing the hand to a surface of the disc such that rotation of the disc causes corresponding rotation of the hand.

10. The method of claim 9, further comprising tilting a head on the body in response to the motor activation.

11. The method of claim 9, wherein rotation of the disc is caused by rotation of a gear inside the body.

12. The method of claim 10, wherein tilting of the head is caused by rotation of a gear inside the body.

13. The method of claim 9, further comprising pressing a button on the toy stringed instrument to cause production of the music and activation of the motor.

14. The method of claim 13, wherein the button is shaped like a musical note.

* * * * *